US007833413B1

(12) United States Patent
Rotondo et al.

(10) Patent No.: US 7,833,413 B1
(45) Date of Patent: Nov. 16, 2010

(54) UNDERGROUND FILTRATION SYSTEM

(76) Inventors: John Rotondo, 3870 N. River St., Arlington, VA (US) 22207; Richard Rotondo, 1321 Gatewood Dr., Alexandria, VA (US) 22307

( * ) Notice: Subject to any disclaimer, the term of this patent is extended or adjusted under 35 U.S.C. 154(b) by 478 days.

(21) Appl. No.: 11/653,845

(22) Filed: Jan. 17, 2007

(51) Int. Cl.
*E03F 5/14* (2006.01)

(52) U.S. Cl. ..... 210/164; 210/170.03; 210/232; 210/254; 210/265; 210/290; 210/299; 210/538

(58) Field of Classification Search ..... 210/163, 210/164, 170.03, 254, 265, 290, 299, 538, 210/232
See application file for complete search history.

(56) References Cited

U.S. PATENT DOCUMENTS 6,241,881 B1 * 6/2001 Pezzaniti ..... 210/155
7,022,243 B2 * 4/2006 Bryant ..... 210/747
7,025,887 B1 * 4/2006 Kirts et al. ..... 210/681
2002/0096466 A1 * 7/2002 Perry, Jr. ..... 210/290
2004/0129622 A1 * 7/2004 Pattee ..... 210/232

* cited by examiner

*Primary Examiner*—Matthew O Savage
(74) *Attorney, Agent, or Firm*—Rosenberg, Klein & Lee

(57) ABSTRACT

A modularized underground liquid run-off filtration system, where a plurality of matingly engaged panels define a storage chamber, a filter chamber and a clear well chamber. The filter chamber includes a first filter chamber section and a second filter chamber section, the first filter chamber section being in fluid communication with the storage chamber. A filter mechanism is positioned within the second filter chamber section for filtering liquid passing from the storage chamber thereto. The clear well chamber is in fluid communication with the second filter chamber section for receiving filtered liquid.

19 Claims, 6 Drawing Sheets

UNDERGROUND FILTRATION SYSTEM

BACKGROUND OF THE INVENTION

Environmental solutions in the field of waste management have become a necessity and developing such solutions an unfulfilled need. One of such environmental solutions is providing a mechanism to filter liquid run-off from buildings or other edifices. Finding a mechanism to effectively and consistently filter liquid run-off is a problem to be solved in the art.

Most filtering techniques designed for buildings or edifices do not appropriately filter liquid run-off, such techniques being unable to filter large debris or, conversely, small particles.

Other filtering mechanisms employed to provide environmental solutions lack in providing consistent filtering solution. Such mechanisms are plagued with problems such as, clogging, and require frequent maintenance to correct such problems.

Associated with maintenance issues is the cost of remedying such problems. Most well-known filtering systems are faulty in that a problem with a portion of the system results in replacement of the entire device. Such systems do not incorporate modularized pieces that are easily replaceable if need be.

FIELD OF THE INVENTION

The subject invention relates to an underground filtration system adapted to be implemented into areas necessitating filtration of liquid run-off from buildings or other types of edifices.

In particular, the subject invention pertains to a modularized liquid run-off underground filtration system which is made up of separate modules that can be rearranged, replaced, combined or interchanged easily.

Still further, the subject invention relates to a filtration system that is formed of pre-cast concrete walls that are easily coupled each to the other such that the filtration system can be adjusted or re-adjusted to fit specific construction requirements based upon a user's need. In particular, the filtration system is designed to be utilized in parking lots or other areas to filter run-off liquid (particularly water) from buildings or other type edifices.

Still further, the subject invention pertains to a filtration system which utilizes a series of chambers in its filtration process. Additionally, the subject invention pertains to a filtering mechanism incorporated into the filtration system for filtration of liquid run-off.

The subject invention further relates to a filtration system that enhances environmental protection. In particular, the present invention directs itself to a filtration system which is adapted to filter liquid run-off and remove debris and other material from the run-off.

PRIOR ART

Filtration systems of various kinds are well-known in the art and readily available to users. They are used, in most instances, to receive in a downstream fashion liquid run-off from various locations.

One problem associated with conventional filtration systems is their limited use. For example, such systems are not modularized in that various components thereof are not interchangeable each with respect to the other to form the overall system.

Another problem associated with conventional filtration systems is the type of filtering mechanism employed to filter the liquid run-off.

The best prior art known to Applicant includes U.S. Pat. Nos. 7,005,060; 7,001,527; 6,749,746; 5,529,436; and Patent Application Publication #2004/0226869.

Prior art systems such as that shown in U.S. Pat. No. 7,005,060 direct themselves to an upflow surface water run-off filtration system. Such systems, however, do not provide for the modularized filtration system nor the filtering mechanism.

Prior art systems such as that shown in U.S. Pat. No. 7,001,527 direct themselves to a storm water treatment apparatus and method. Such systems do not provide for defined chambers utilized in the filtration system to filter liquid run-off.

Prior art systems such as that shown in U.S. Pat. No. 6,749,746 direct to catch basin traps with filters. However, such prior art systems do not provide for modularized filtration system being formed of separate chambers for use in its filtration system.

Prior art systems such as that shown in U.S. Pat. No. 5,529,436 direct themselves to trench drain systems. Such systems, however, do not provide for the proper removability of debris from liquid run-off.

Other prior art systems such as that shown in Pre-Grant Publication #2004/0226869 direct themselves to storm drain curb-inlet multi-stage filtration units. However, such prior art systems do not provide for the increased ability to remove debris and other contaminants from liquid run-off.

SUMMARY OF THE INVENTION

The present invention provides a modularized underground liquid run-off filtration system that increases the limited use of conventional filtration systems.

It is one object of the present invention to provide a modularized filtration system including a filtering mechanism and various collection chambers. The filtration system is made up of separate modules that can be rearranged, replaced, combined or interchanged easily. As such, the filtration system can be adjusted or readjusted to fit specific construction requirements based upon a user's need. Furthermore, in the event of damage to any portion of the filtration system, such can be replaced in a manner without affecting the overall filtration system, thus lowering costs associated with maintenance of such systems.

It is another object of the present invention to provide a filtration system which more efficiently filters contaminants and debris in liquid run-off thus being more environmentally sound.

It is yet another object of the present invention to provide an underground filtration system which utilizes a particular filtering mechanism which utilizes an enhanced filtering mechanism to filter the liquid run-off.

It is still further an object of the present invention to provide an underground filtration system which is a cost-effective environmental solution.

It is yet another object of the present invention to provide an underground filtration system which eliminates multiple maintenance requirements associated with conventional filtration systems.

DESCRIPTION OF THE PREFERRED EMBODIMENTS

Figure 1:
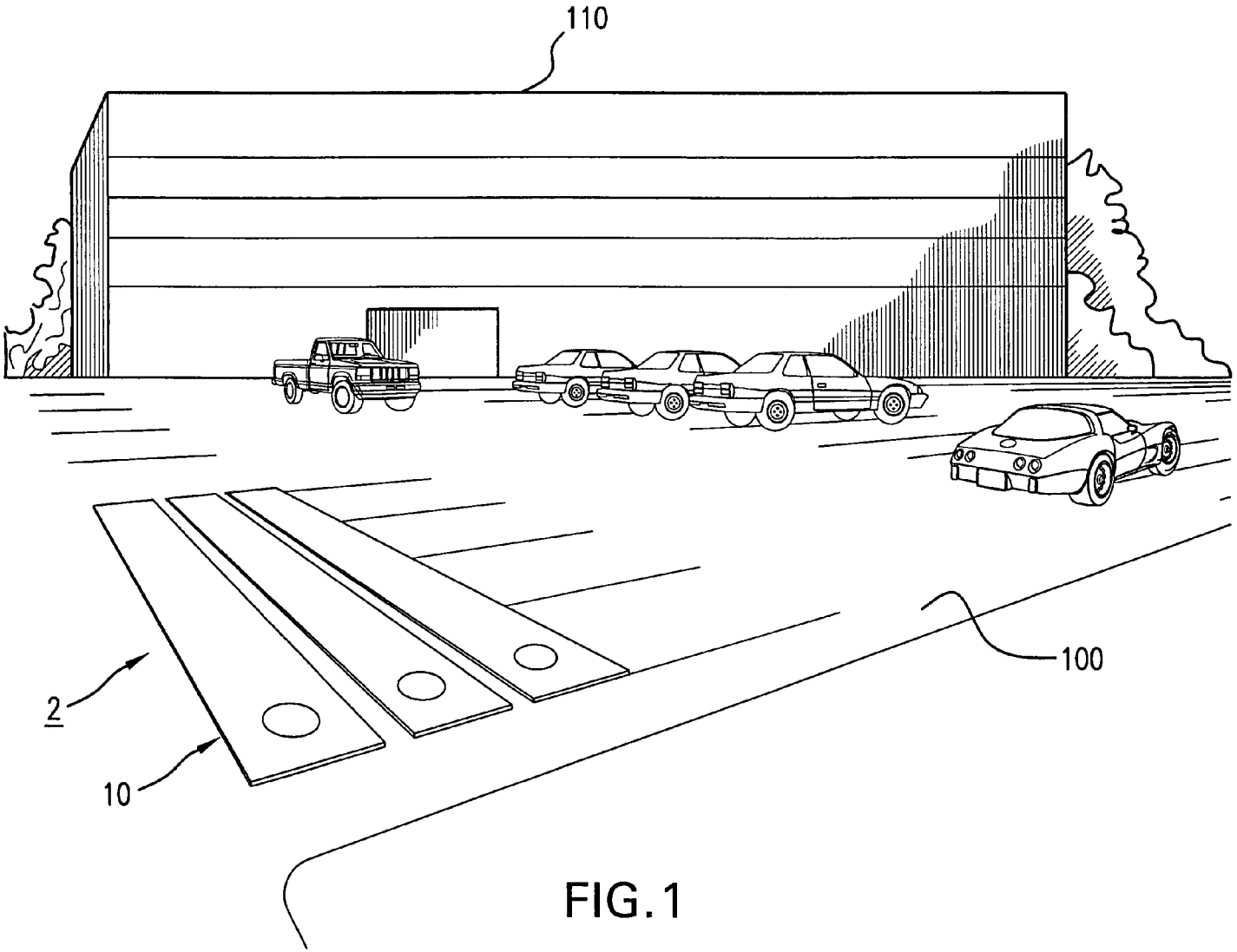
FIG. 1 is an illustrative view of an application of the subject invention.

Referring now to FIGS. 1-7, there is shown a modularized underground liquid run-off filtration system 2, which is used to filter liquid run-off. The filtration system 2 is directed to an underground filtering system which can be placed into parking lots 100 or other areas to filter run-off liquid (for example water) from a building 110 or other type edifice. In general, the filtration system 2 is formed of a plurality of matingly engaged panels positioned in contiguous contact, each with respect to the other, in order to provide various chambers of the system 2. As will be discussed in further paragraphs, the matingly engaged panels are formed of a pre-cast concrete or like material and mounted underground to define various chambers of the system 2. FIG. 1 illustrates that system 2 placed into a parking lot of a building or edifice 110 for collecting liquid run-off therefrom.

The filtration system 2 is one which is modularized, in that, the system 2 is made up of separate modules (panels) that can be rearranged, replaced, combined or easily interchanged. As such, the filtration system 2 can be adjusted or re-adjusted to fit specific construction requirements based upon a user's need. Furthermore, in the event of damage to any of the panels, such can be replaced in a manner without affecting the overall filtration system 2.

Figure 2:
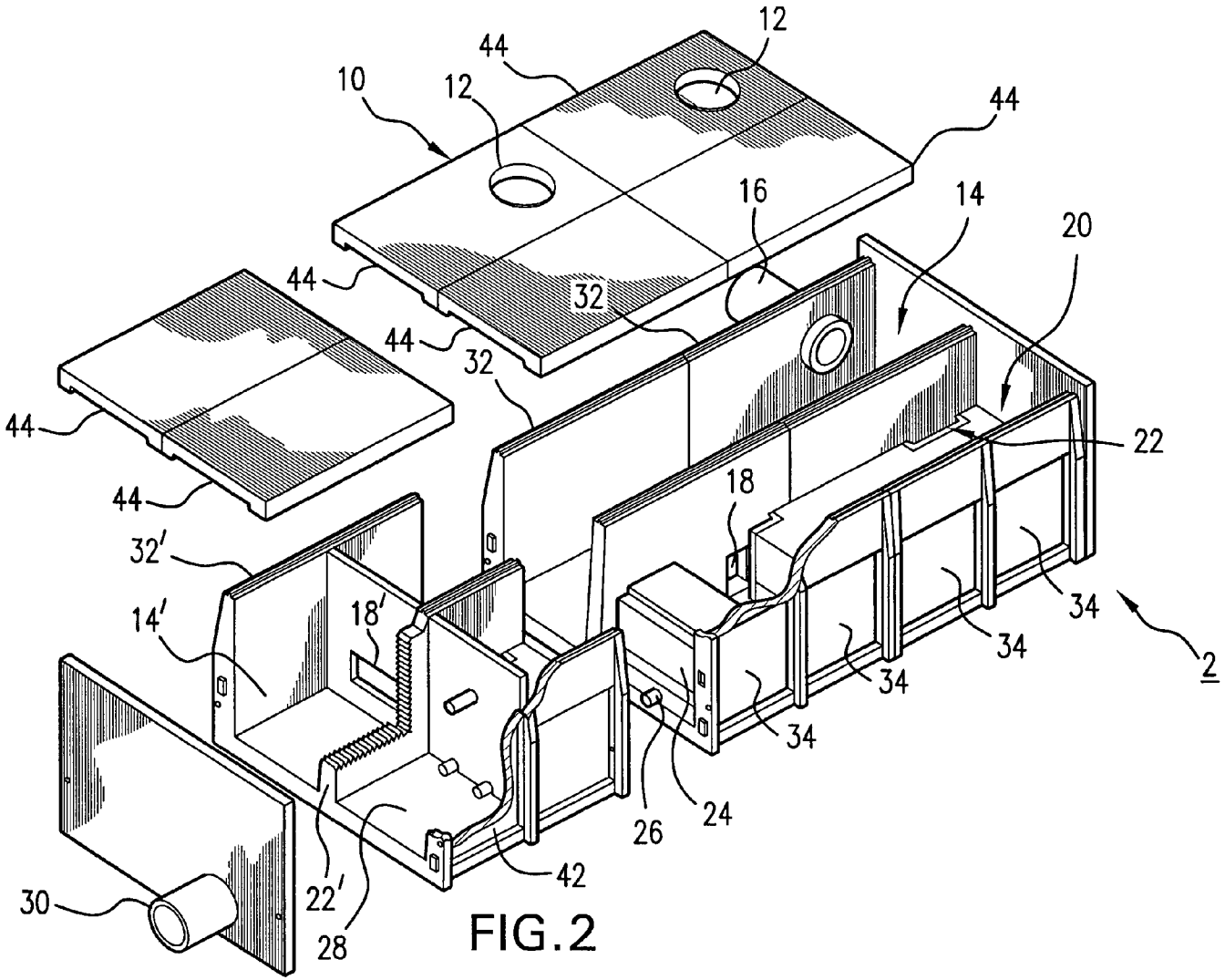
FIG. 2 is a perspective view of the preferred embodiment of the invention.
Figure 3:
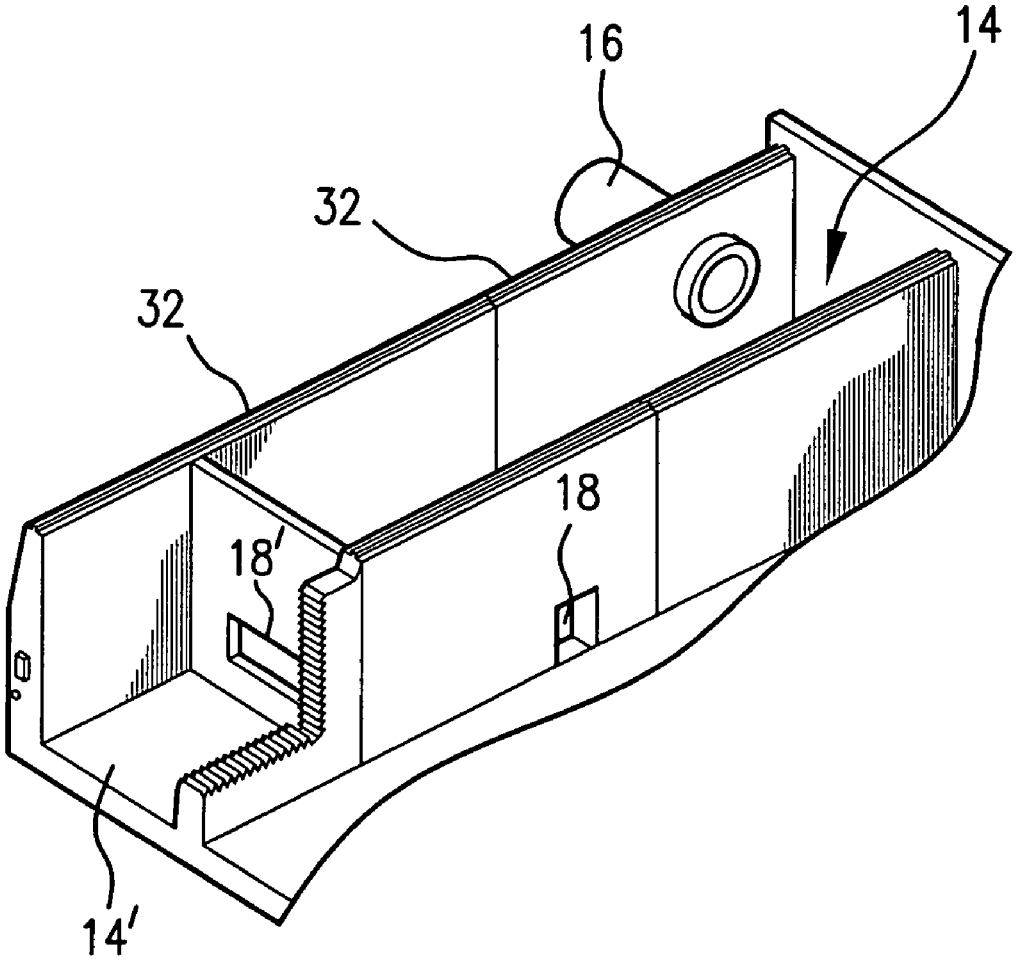
FIG. 3 is a sectional view of the storage chamber.

Referring now to FIG. 2, the filtration system 2 comprises a plurality of matingly engaged substantially planar storage chamber panels 32 that are individually removable and replaceable and that define a vertical planar exterior storage chamber wall of a storage chamber 14. As will be detailed in further paragraphs, the storage chamber 14 is the initial location where a liquid run-off collects subsequent to entering further sections of the filtration system 2. The storage chamber 14 accommodates all types of debris included in liquid run-off and can be fabricated of a size appropriate to be the initial collection point of the run-off. The storage chamber panels 32 are designed to fit a particular need of a user in terms of size and positioning arrangement as the panels are modules as detailed above.

The filtration system 2 further comprises a filtration system bypass chamber 14'. The filtration system bypass chamber 14' is formed of a plurality of filtration system bypass chamber panels 32' that are individually removable and replaceable for forming a vertical planar exterior bypass chamber wall that is coplanar with the storage chamber wall and that has an end that is matingly engaged with an end of the storage chamber wall. The vertical planar exterior bypass chamber wall defines the filtration system bypass chamber 14'. The filtration system bypass chamber 14' is in fluid communication with the storage chamber 14 by way of a filtration system bypass opening 18'. In a preferred embodiment, the filtration system bypass opening 18' is below a liquid level in the storage chamber 14. Thus, debris and other materials float on the top of the liquid run-off and only liquid or water passes from the storage chamber 14 to the filtration system bypass chamber 14'. As shown in FIG. 2, the exterior bypass chamber wall is coplanar with the exterior storage chamber wall and has an end that is matingly engaged with an end of the exterior storage chamber wall. The bypass chamber is in fluid communication with the storage chamber for receiving un-filtered liquid via a bypass opening formed in a second vertical planar divider panel for separating the storage chamber from the bypass chamber.

The purpose of the filtration system bypass chamber 14' is to allow liquid run-off to pass there through and bypass portions of the filtration system 2 and the filtration process when liquid run-off exceeds the design parameters of the filtration system 2. However, large debris is filtered due to the positioning of the filtration system bypass opening 18' lower than the liquid level in the storage chamber 14. As will be detailed below, liquid run-off collecting in filtration system bypass chamber 14' will the flow to another portion of the filtration system 2.

The filtration system 2 further comprises a plurality of matingly engaged substantially planar filter chamber panels 34 that are individually removable and replaceable and that define a vertical planar exterior filter chamber wall of a filter chamber 20. As will be discussed in greater detail, the filter chamber 20 receives liquid from the initial collection point namely, the storage chamber 14. Thus, a portion of the filter chamber 20 is in fluid communication with the storage chamber 14. Additionally, similar to the storage chamber panels 32, the filter chamber panels 34 can be designed according to a user's need dependent on the size, etc. to fit a particular required construction.

As shown in FIG. 2, a plurality of matingly engaged substantially planar first partition panels for forming a first vertical planar partition wall are provided, the first vertical planar partition wall being positioned between and parallel to the exterior storage chamber wall and the exterior filter chamber wall for separating the storage chamber from the filter chamber. The first filter chamber section is in fluid communication with the storage chamber via a storage chamber opening in one of the first partition panels.

Figure 5:
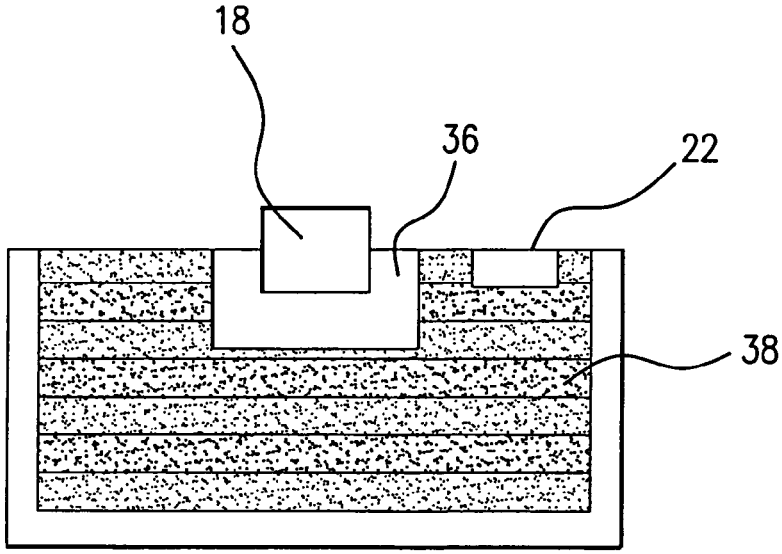
FIG. 5 is a top view of the filtering chamber.

As shown in FIG. 5, the filter chamber 20 includes a first filter chamber section 36 and a second filter chamber section 38. In the preferred embodiment, the first filter chamber section 36 is in fluid communication with the storage chamber 14, as will be detailed below. The first filter chamber section 36 is in fluid communication with the second filter chamber section 38. The first filter chamber section 36 transports a liquid run-off from the storage chamber 14 in a particular manner to the second filter chamber section 38. The first filter chamber section 36 includes a storage chamber opening 18 which allows fluid communication therebetween. As will be detailed in following paragraphs, in a preferred embodiment the storage chamber opening 18 forms a part of a filter mechanism of the filtration system 2.

Figure 4:
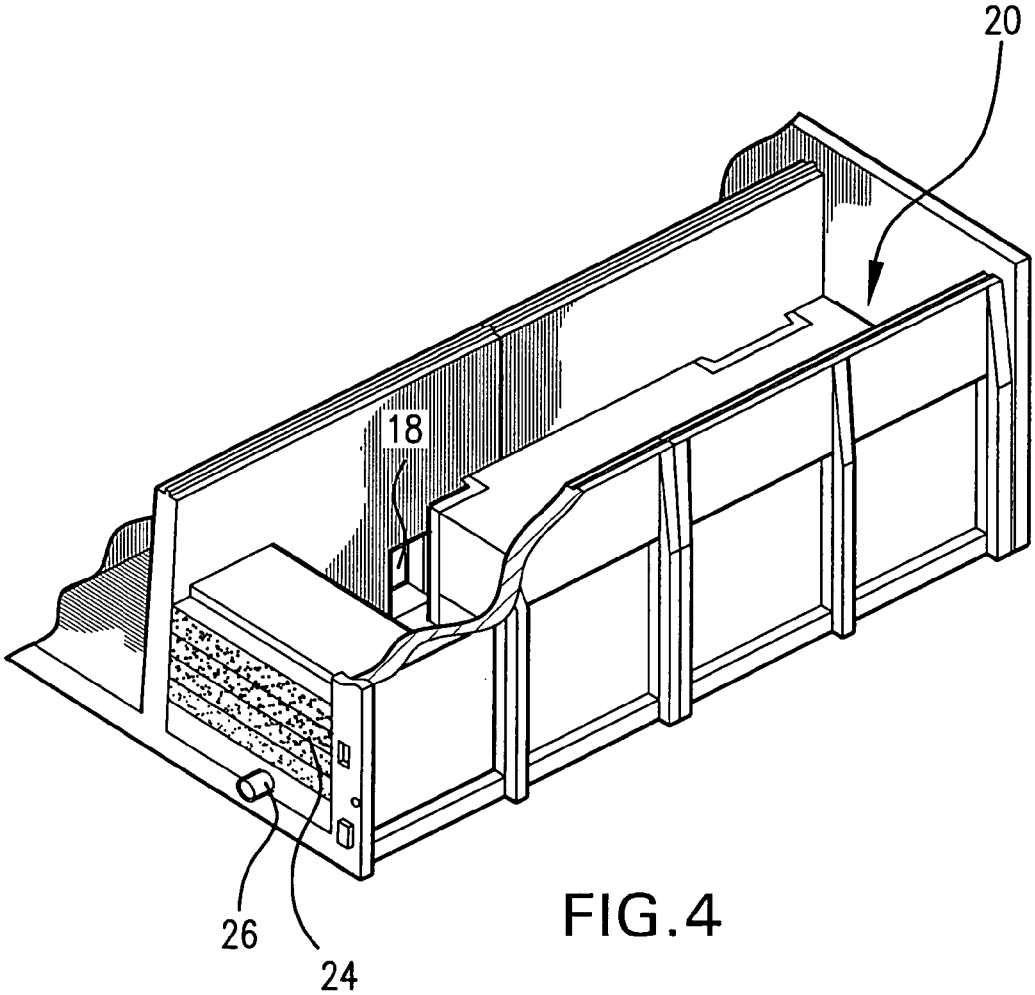
FIG. 4 is a sectional view of the filtering chamber.
Figure 6:
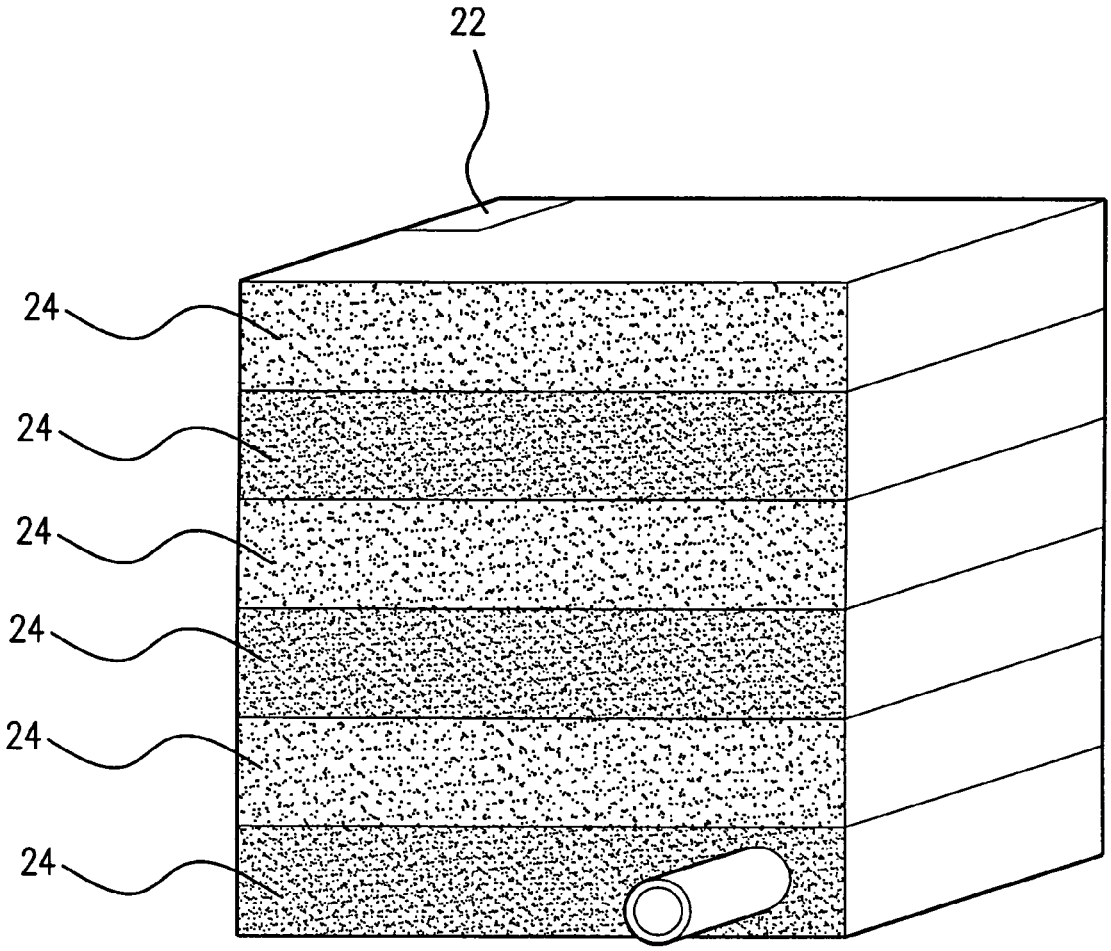
FIG. 6 is an exploded view of the filtering mechanism.

Referring now to FIGS. 2, 4 and 6, the filtration system 2 further includes a filter mechanism 24 that is disposed in the filter chamber 20. In the preferred embodiment, the filter mechanism 24 is disposed within the second filter chamber section 38 for filtering liquid passing from the storage chamber 14 to the filter chamber 20 through the storage chamber opening 18 and into the first filter chamber section 36. The filter mechanism 24 includes a spillover mechanism 22 which controls liquid run-off flow into the filter mechanism 24. In the preferred embodiment, the storage chamber opening 18 is positioned substantially near a bottom of the storage chamber 14. As the storage chamber opening allows for fluid communication between the first filter chamber section 36 and the storage chamber 14, such leads into a bottom of the first filter chamber section 36. The spillover mechanism 22 of the filter mechanism 24 is positioned relatively above or higher than the storage chamber opening 18. As the storage chamber opening 18 is lower than the spillover mechanism 22, when liquid run-off passes over the spillover mechanism 22, it is then filtered through the rest of the filter mechanism 24, as will be detailed in following paragraphs.

In the preferred embodiment, the storage chamber opening 18 is below a liquid level in the storage chamber 14. Thus, debris and other materials will float on the top of the liquid and only liquid or water passes from the storage chamber 14 into the first filter chamber section 36 through the storage chamber opening 18. As such, as the liquid level rises and liquid flows into the filter mechanism 24, such is controlled by the spillover mechanism 22. The spillover mechanism 22 controls liquid flow into the filter mechanism 24. The filter mechanism 24 includes at least one filter layer. The filter layer may be any type of well known filtered material. In the preferred embodiment, the filtering mechanism includes a plurality of filter layers. The filter layers are combinations of materials chosen from crushed stone, sand, and filter fabric. The filter layers may also include or be made fully of other types of filter medias, such as, filters used in bio-retentions. In the preferred embodiment, the filter layers include a first layer of crushed stone, a second layer of filter fabric disposed below the first layer of crushed stone, and a third lager of crushed stone disposed below the second layer of fabric. Thus, as liquid flow is controlled by the spillover mechanism 22 entering into the filter mechanism 24, such controls the liquid entering the filter layer or filter layers (dependent on the type of construction) which then filters the liquid.

Figure 7:
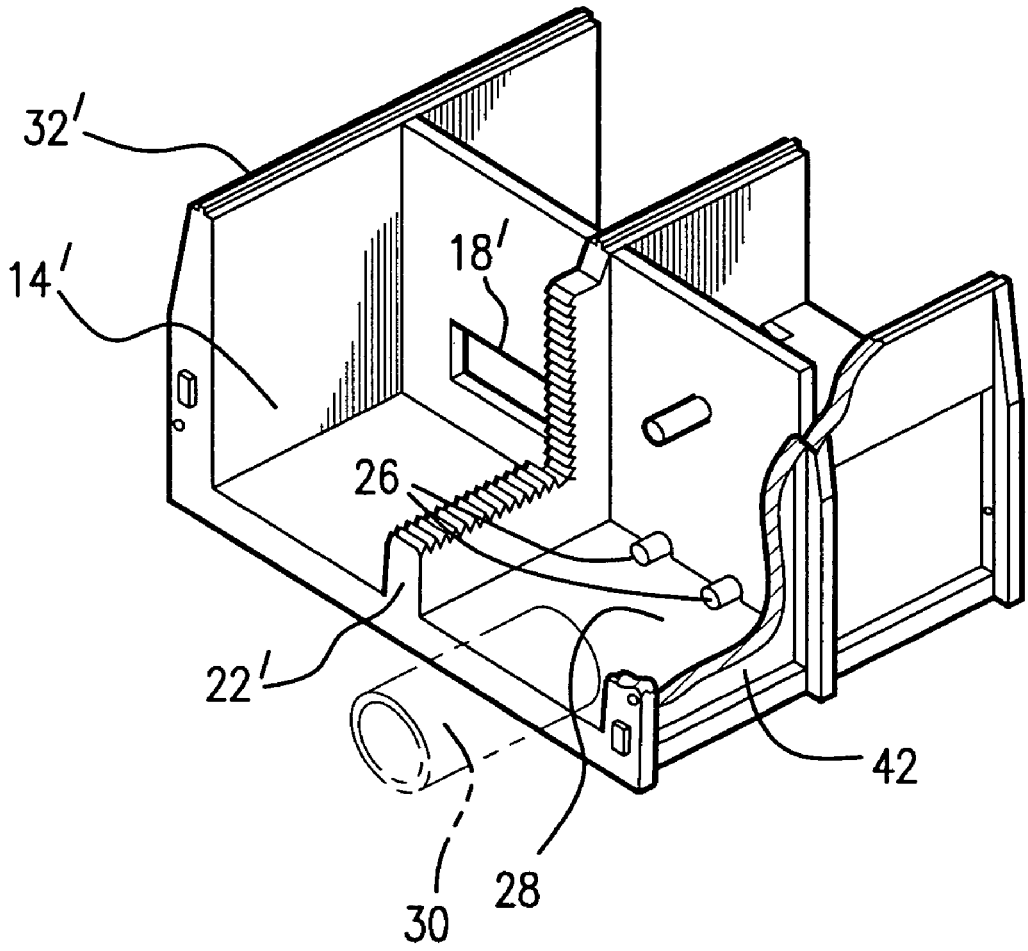
FIG. 7 is a sectional view of the clear well chamber.

Referring now to FIGS. 2 and 7, the filtration system 2 further comprises a plurality of matingly engaged clear well chamber panels 42 that are individually removable and replaceable that define a vertical planar exterior clear well chamber wall of a clear well chamber 28. The clear well chamber 28 is in fluid communication with the second filter chamber section 38 and receives filtered liquid therefrom. The clear well chamber panels 42, much like the filter chamber panels 34 and storage chamber panels 32 may be arranged and re-arranged according to a user's need. Additionally, dependent on construction, the clear well chamber panels 42 may be fitted and arranged to define the clear well chamber 28. The clear well chamber 28 is in fluid communication with the second filter chamber section 38 by an exit opening 26 in the filter mechanism 24. The Exit opening 26 couples the filter mechanism 24 in the second filter chamber section 38 to the clear well chamber 28. As such, the clear well chamber 28 collects the filtered liquid that has passed through the filter mechanism 24. As shown in FIG. 2, the exterior clear well chamber wall is coplanar with the filter chamber wall and has an end that is matingly engaged with an end of the filter chamber wall. The clear well chamber is in fluid communication with the second filter chamber section for receiving filtered liquid via an exit opening formed in a first vertical planar divider panel that separates the filter chamber from the clear well chamber;

As detailed above, the filtration system 2 includes a filtration system bypass chamber 14'. Liquid run-off that collects in the filtration system bypass chamber 14' when total run-off exceeds design requirements of the filtrations system 2 passes into the clear well chamber 28. The filtration system bypass chamber 14' further includes a weir surface 22' which controls the flow of liquid run-off into the clear well chamber 28.

As shown in FIG. 2, a second vertical planar partition wall is coplanar with said first vertical planar partition wall and that has an end that is matingly engaged with an end of said first vertical planar partition wall. The second vertical planar partition wall is positioned between and parallel to the exterior clear well chamber wall and the exterior bypass chamber wall for separating the bypass chamber from the clear well chamber. The second vertical planar partition wall has a weir surface.

Referring to FIGS. 2 and 7, the filtration system 2 further comprises a discharge pipe 30 that is in fluid communication with the clear well chamber 28 for discharging filtered liquid. Thus, as filtered liquid from the filter chamber 20 collects in the clear well chamber 28 from the exit opening after the second filter chamber section 38, such then is discharged through the discharge pipe 30.

Referring to FIG. 2, the filtration system further includes a plurality of matingly engaged cover panels that define a cover member for covering the filtration system. Much like the panels of the storage chamber 14 and filter chamber 20 and clear well chamber 28, the cover panels 44 are arrangeable and re-arrangeable based on a user's need. Thus, dependent on the construction and the grounds in which the filtration system 2 will be arranged, the cover panels 44 will be arranged accordingly as well. The cover member 10 includes at least one cover member opening 12 that is in fluid communication with the storage chamber 14. The cover member opening allows liquid run-off to pass therethrough and either directly or indirectly passes the liquid to the storage chamber 14. In the preferred embodiment, the cover member opening includes a grate or other like perforated opening to allow the passage of liquid run-off. The cover member opening 12 may be in fluid communication with the storage chamber 14 as shown in FIG. 2. However, other manners of coupling in fluid communication the cover member opening 12 and the storage chamber 14 may be employed.

Referring to FIG. 1, the overall filtration system as applied to a parking lot 100 is shown. In this illustration, the cover member 10 defined by the cover panels 44 is positioned at ground-level. Other components of the filtration system 2 are positioned beneath ground level thus forming the overall underground liquid run-off filtration system 2. As such, the storage chamber 14, filter chamber 20 including the filter mechanism 24 and the clear well chamber 28 are all located subground-level with only the cover member 10 being at ground-level.

The filtration system 2 as detailed above operates in the following manner: liquid run-off flows through the at least one cover member opening 12 in the cover member 10 into the storage chamber 14. As detailed above, the cover member opening 12 may be directly in fluid communication with the storage chamber 14 or indirectly in fluid communication through an inlet pipe 16 external to the filtration system as is shown in FIG. 2. The storage chamber 14 includes a storage chamber opening 18 formed substantially near a bottom thereof. As liquid run-off gathers within the storage chamber 14, such moves through the storage chamber opening into the first filter chamber section 36 of the filter chamber 20. Since the storage chamber opening 18 is substantially near a bottom of the storage chamber 14, large debris and other materials to be filtered out of the liquid remain floating on the liquid and only water or other liquid passes from the storage chamber 14 through the storage chamber opening 18 into the first filter chamber section 36. Liquid run-off passes from the first filter chamber section 36, as the level rises, to the spillover mechanism 22 of the filter mechanism 24 which controls flow of the liquid into the filtering mechanism 24. Such occurs due to the positioning of the spillover mechanism 22 above the storage chamber opening 18. Liquid run-off then flows through layers of the filter mechanism 24 (including crushed stone, sand, filter fabric, etc.) through at least one exit opening 26 of the filter mechanism 24. The filter mechanism 24 may also include other filter media, such as, but not limited to, medias used in bio-retention. The exit opening 26 is in fluid communication with the clear well chamber 28 and liquid run-off accordingly flows into the clear well chamber 28. As the liquid run-off is received by the clear well chamber 28, such is discharged through a discharge pipe 30 in fluid communication with the clear well chamber 28.

The subject modularized underground liquid run-off filtration system 2 is particularly directed to a modularized system which permits a plurality of chambers 14, 20 and 28 to be easily constructed in fluid communication each with respect to the other in a manner which allows individual panels to be replaced or added to form new chambers as needed. The individual panels forming the specific chambers may be replaced while maintaining the fluid communication between the individual chambers. The fluid communication between storage chamber 14 and filter chamber 20 relies upon the principal of separating large waste material having a density less than water with respect to other particulates or waste which have a density greater than the waste water being filtered. The chamber 14 and the associated through opening 18 which is located in a lower section of panel 32 permits the waste material having a density greater than the waste water to be passed therethrough while the level of the water in chamber 14 is higher than the opening 18 and permits the large waste material to be maintained within chamber 14. In this manner, waste material may be segregated into large waste material elements which are maintained within chamber 14 while a partially filtered waste water is passed through opening 18.

The partially filtered water passing through opening 18 may then fill filter chamber 20 and pass over the weir or opening or spillover mechanism 22. Subsequent to this, partially filtered waste water then passes through the filtration mechanism 24 to be expelled into chambers 28.

As can be seen from the Figures, the panels forming the filtration system 2 are generally planar in contour and can be easily sized to permit attachment each to the other to form the associated chambers. In this manner, a modularized system is created whereby individual panels, either due to deterioration or other degradation can be removed and a new panel simply inserted to maintain the filtration system 2 in an ongoing filtering process.

Although this invention has been described in connection with specific forms and embodiments thereof, it will appreciated that various modifications of those discussed above may be resorted to without departing from the spirit or scope of the invention. For example, functionally equivalent elements may be substituted for those specifically shown and described. It is understood, therefore, that this invention is not limited to the particular embodiments disclosed, but is intended to cover modifications within the spirit and scope of the present invention as defined by the appended Claims.

What is claimed is:

1. A modularized underground liquid run-off filtration system comprising:

a plurality of matingly engaged substantially planar storage chamber panels, said substantially planar storage chamber panels being individually removable and replaceable and defining a substantially vertical planar exterior storage chamber wall of a storage chamber;

a plurality of matingly engaged substantially planar filter chamber panels, said substantially planar filter chamber panels being individually removable and replaceable and defining a substantially vertical planar exterior filter chamber wall of a filter chamber having a first filter chamber section and a second filter chamber section, said first filter chamber section being in fluid communication with said storage chamber;

a plurality of matingly engaged substantially planar first partition panels for forming a first substantially vertical planar partition wall, said first substantially vertical planar partition wall being positioned between and substantially parallel to said exterior storage chamber wall and said filter chamber wall for separating the storage chamber from the filter chamber, wherein said first filter chamber section is in fluid communication with said storage chamber via a storage chamber opening in one of said first partition panels;

a filter mechanism positioned in said second filter chamber section for filtering liquid passing from said storage chamber to said filter chamber;

a plurality of matingly engaged clear well chamber panels being individually removable and replaceable for forming a substantially vertical planar exterior clear well chamber wall of a clear well chamber, said clear well chamber wall being substantially coplanar with said filter chamber wall and having an end that is matingly engaged with an end of said filter chamber wall, said clear well chamber being in fluid communication with said second filter chamber section for receiving filtered liquid via an exit opening formed in a first substantially vertical planar divider panel for separating said filter chamber from said clear well chamber; and a plurality of matingly engaged bypass chamber panels being individually removable and replaceable for forming a substantially vertical planar exterior bypass chamber wall of a bypass chamber, said bypass chamber wall being substantially coplanar with said exterior storage chamber wall and having an end that is matingly engaged with an end of said exterior storage chamber wall, said bypass chamber being in fluid communication with said storage chamber for receiving un-filtered liquid by a bypass opening formed in a second substantially vertical planar divider panel for separating said storage chamber from said bypass chamber;

a second substantially vertical planar partition wall that is substantially coplanar with said first substantially vertical planar partition wall and that has an end that is matingly engaged with an end of said first substantially vertical planar partition wall, said second substantially vertical planar partition wall being positioned between and substantially parallel to said clear well chamber wall and said bypass chamber wall for separating the bypass chamber from the clear well chamber, said second substantially vertical planar partition wall having a weir surface;

wherein said bypass opening is below a liquid level in the storage chamber and the weir surface controls a flow of un-filtered liquid from the bypass chamber into the clear well chamber.

2. The modularized underground liquid run-off filtration system as recited in claim 1, wherein said at least one storage chamber opening is positioned substantially near a bottom of said storage chamber.

3. The modularized underground liquid run-off filtration system as recited in claim 2, wherein said filter mechanism includes a spillover mechanism for controlling liquid flow into said filter mechanism.

4. The modularized underground liquid run-off filtration system as recited in claim 3, wherein said spillover mechanism is positioned above said at least one storage chamber opening.

5. The modularized underground liquid run-off filtration system as recited in claim 1, wherein said filter mechanism includes at least one filter layer.

6. The modularized underground liquid run-off filtration system as recited in claim 5, wherein said at least one filter layer is crushed stone.

7. The modularized underground liquid run-off filtration system as recited in claim 5, wherein said at least one filter layer is sand.

8. The modularized underground liquid run-off filtration system as recited in claim 1, further comprising a discharge pipe in fluid communication with said clear well chamber for discharging filtered liquid.

9. The modularized underground liquid run-off filtration system as recited in claim 1, further comprising a plurality of matingly engaged cover panels defining a cover member for covering said filtration system, said cover member including at least one cover member opening in fluid communication with said storage chamber.

10. A modularized underground liquid run-off filtration system comprising:

a plurality of matingly engaged substantially planar storage chamber panels, said substantially planar storage chamber panels being individually removable and replaceable and defining a substantially vertical planar exterior storage chamber wall of a storage chamber;

a plurality of matingly engaged substantially planar filter chamber panels, said substantially planar filter chamber panels being individually removable and replaceable and defining a substantially vertical planar exterior filter chamber wall of a filter chamber having a first filter chamber section and a second filter chamber section, said first filter chamber section being in fluid communication with said storage chamber;

a plurality of matingly engaged substantially planar first partition panels for forming a first substantially vertical planar partition wall, said first substantially vertical planar partition wall being positioned between and substantially parallel to said exterior storage chamber wall and said filter chamber wall for separating the storage chamber from the filter chamber, wherein said first filter chamber section is in fluid communication with said storage chamber via a storage chamber opening in one of said first partition panels;

a filter system positioned in said filter chamber for filtering liquid passing from said storage chamber to said filter chamber, a spillover mechanism and at least one filtering layer, said at least one storage chamber opening positioned substantially at a bottom of said first filter chamber section and in fluid communication with said storage chamber, said spillover mechanism disposed in said second filter chamber section and positioned substantially higher than said at least one first filter chamber section opening, said spillover mechanism controlling liquid flow to said at least one filter layer;

a plurality of matingly engaged clear well chamber panels being individually removable and replaceable for forming a substantially vertical planar exterior clear well chamber wall of a clear well chamber, said clear well chamber wall being substantially coplanar with said filter chamber wall and having an end that is matingly engaged with an end of said filter chamber wall, said clear well chamber being in fluid communication with said second filter chamber section for receiving filtered liquid via an exit opening formed in a first substantially vertical planar divider panel for separating said filter chamber from said clear well chamber; and a plurality of matingly engaged bypass chamber panels being individually removable and replaceable for forming a substantially vertical planar exterior bypass chamber wall of a bypass chamber, said bypass chamber wall being substantially coplanar with said exterior storage chamber wall and having an end that is matingly engaged with an end of said exterior storage chamber wall, said bypass chamber being in fluid communication with said storage chamber for receiving un-filtered liquid by a bypass opening formed in a second substantially vertical planar divider panel for separating said storage chamber from said bypass chamber;

a second substantially vertical planar partition wall that is substantially coplanar with said first substantially vertical planar partition wall and that has an end that is matingly engaged with an end of said first substantially vertical planar partition wall, said second substantially vertical planar partition wall being positioned between and substantially parallel to said clear well chamber wall and said bypass chamber wall for separating the bypass chamber from the clear well chamber, said second substantially vertical planar partition wall having a weir surface;

wherein said bypass opening is below a liquid level in the storage chamber and the weir surface controls a flow of un-filtered liquid from the bypass chamber into the clear well chamber.

11. The modularized underground liquid run-off filtration system as recited in claim 10, wherein said at least one filter layer is crushed stone.

12. The modularized underground liquid run-off filtration system as recited in claim 10, wherein said at least one filter layer is sand.

13. The modularized underground liquid run-off filtration system as recited in claim 10, further comprising a discharge pipe in fluid communication with said clear well chamber for discharging filtered liquid.

14. The modularized underground liquid run-off filtration system as recited in claim 10, further comprising a plurality of matingly engaged cover panels defining a cover member for covering said filtration system, said cover member including at least one cover member opening in fluid communication with said storage chamber.

15. The modularized underground liquid run-off filtration system as recited in claim 10, further comprising a plurality of filter layers disposed below said spillover mechanism, each said filter layer being contiguous to the other.

16. The modularized underground liquid run-off filtration system as recited in claim 15, wherein said plurality of filter layers include a first layer of crushed stone, a second layer of filter fabric disposed below said first layer of crushed stone, and a third layer of crushed stone disposed below said second layer of filter fabric.

17. The modularized underground liquid run-off filtration system as recited in claim 10, wherein each of said plurality of matingly engaged storage chamber panels is interchangeable each with the other to define said storage chamber.

18. The modularized underground liquid run-off filtration system as recited in claim 10, wherein each of said plurality of matingly engaged filter chamber panels is interchangeable each with the other to define said filter chamber.

19. The modularized underground liquid run-off filtration system as recited in claim 10, wherein each of said plurality of matingly engaged clear well chamber panels is interchangeable each with the other to define said clear well chamber.

* * * * *